US007090218B2

(12) United States Patent
Yamazaki

(10) Patent No.: US 7,090,218 B2
(45) Date of Patent: Aug. 15, 2006

(54) STRATEGIC BOARD GAME

(75) Inventor: Koichi Yamazaki, Tokyo (JP)

(73) Assignee: Bandai America Incorporated, Cypress, CA (US)

( * ) Notice: Subject to any disclaimer, the term of this patent is extended or adjusted under 35 U.S.C. 154(b) by 0 days.

(21) Appl. No.: 10/897,566

(22) Filed: Jul. 23, 2004

(65) Prior Publication Data

US 2006/0017226 A1 Jan. 26, 2006

(51) Int. Cl.
*A63F 3/00* (2006.01)

(52) U.S. Cl. ..... 273/236; 273/262

(58) Field of Classification Search ..... 273/255, 273/258, 260, 261, 288, 289, 290, 236
See application file for complete search history.

(56) References Cited

U.S. PATENT DOCUMENTS 5,556,099 A * 9/1996 Mardirosian ..... 273/241
6,062,562 A * 5/2000 Pardee ..... 273/248
6,755,416 B1 12/2002 Nakamoto
6,755,711 B1 12/2002 McClung et al.
6,758,475 B1 5/2003 Newton
6,755,418 B1 6/2004 Jackson
2004/0124584 A1 7/2004 Ioannis

* cited by examiner

*Primary Examiner*—Vishu K. Mendiratta
(74) *Attorney, Agent, or Firm*—Lewis Brisbois Bisgaard & Smith LLP; Sanford Astor

(57) ABSTRACT

A strategy board game is disclosed. The board for the game or playmat is comprised of several distinct regions each with a specific purpose and/or rules associated with the region. The Battlefield region is where opposing players challenge one another with various game pieces. There is also a region for keeping certain game pieces while they await to be summoned to the Battlefield. Another region, the Graveyard, is were game pieces are placed after such game pieces are taken by an opponent. Another region of the playmat is designated for the storing of currency used during play. Certain game pieces have fixed properties and other have properties that can be changed by the player during the course of the game at strategic times. A player can change the properties of a game piece by paying the cost associated therewith using the currency he or she has earned by moving game pieces and/or taking an opponents game pieces. The game can be won by capturing a special game piece of the opponent; by moving a special game piece into across the length of the playmat and into the opponent's area for storing game pieces which have not been summoned; by changing the properties of a special game piece or through the surrender to the opponent.

14 Claims, 6 Drawing Sheets

STRATEGIC BOARD GAME

BACKGROUND OF THE INVENTION

This invention relates to improved methods and game pieces for playing board games.

BRIEF DESCRIPTION OF THE DRAWINGS

Some of the objects and advantages of the present invention are shown in the detailed description that follows and the accompanying drawings, which are not necessarily drawn to scale.

DETAILED DESCRIPTION OF THE INVENTION

Objects, features, and advantages of the present invention will become apparent for the following detailed description of the embodiments of the invention. Although the invention will be described below in reference to specific embodiments, many changes and modifications of the invention may become apparent to those skilled in the art without departing from the spirit and scope of the invention.

The game disclosed herein is called Navia Dratp and is a totally innovative game that fuses chess with fantasy. In one embodiment disclosed below, the game is played-by at least two players each of whom have control over a group of game pieces made up of pieces with fixed properties, such as movement, and pieces whose properties can be altered by the players during the game.

I. The Playmat

Figure 1:
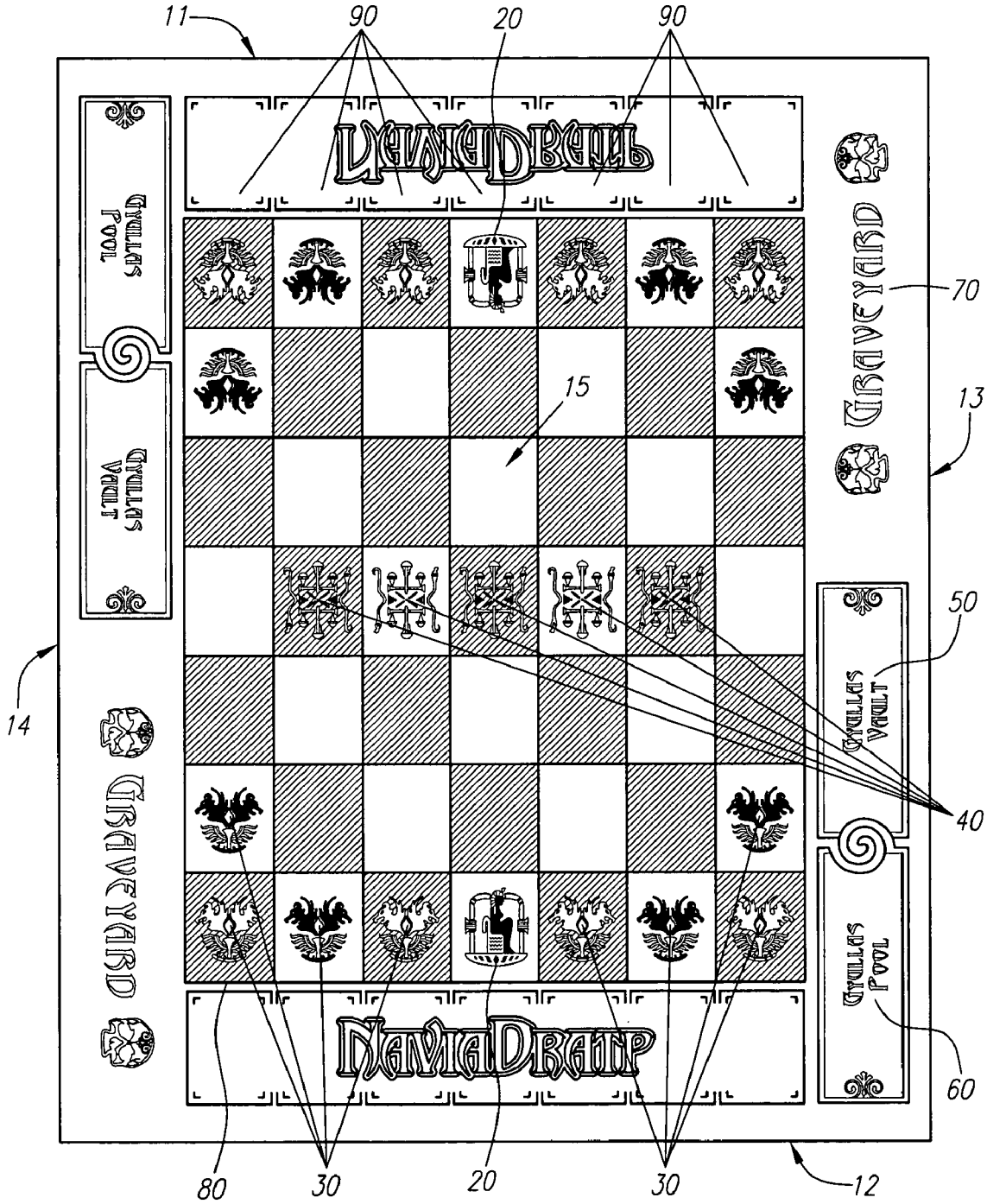
FIG. 1 is a drawing of a playing board suitable for use with the disclosed invention.
Figure 2:
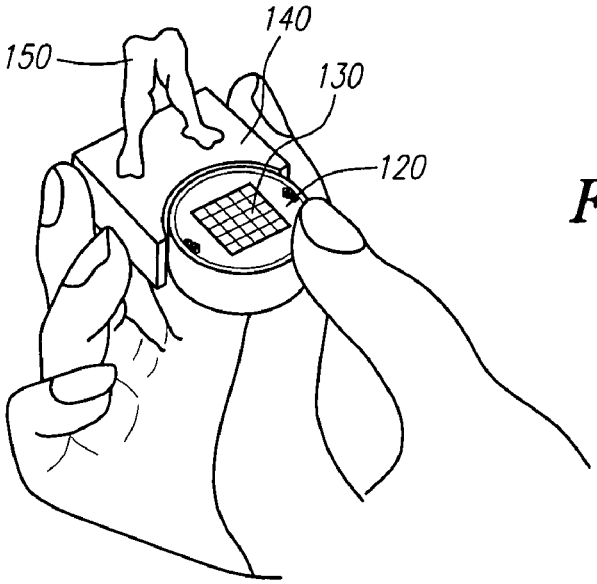
FIG. 2 is a drawing of a game piece used for playing the disclosed invention.
Figure 3:
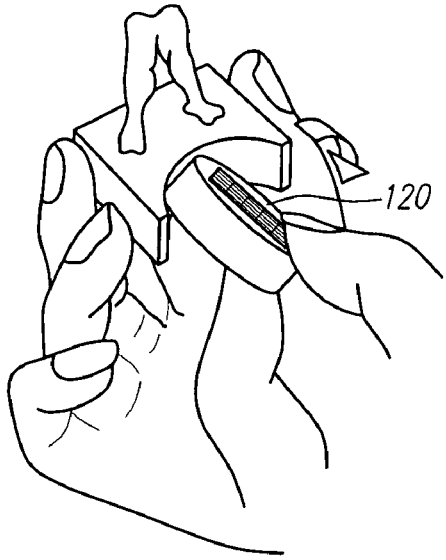
FIG. 3 is a drawing of a game piece showing the rotational aspect of a portion thereof.
Figure 4:
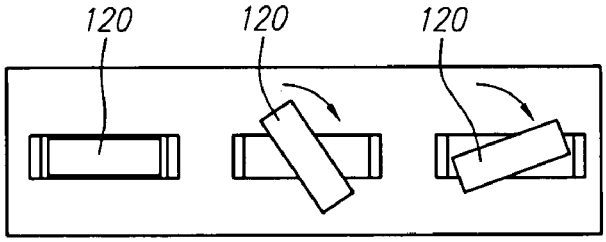
FIG. 4 is a drawing that depicts the rotational portion of the game piece being rotated 180° from its starting position.

FIG. 1 illustrates a rectangular board or playmat 10 suitable for practicing the present invention. The playmat 10 has a top end 11, a bottom end 12, and a right side 13 and a left side 14 and various distinct areas designated for specific aspects of game play. Players of the game each pick an end from which to set up their respective game pieces at the beginning of play.

In one embodiment of the present invention, the game board has an inner section wherein the majority of actual game play is conducted. This section is termed the Battlefield and consists of a section of squares arranged in a seven-by-seven pattern as shown in FIG. 1. These squares are arranged in rows and columns. In FIG. 1 the rows are arranged horizontally and the columns are arranged vertically.

The middle square 20 in the row of Battlefield squares closest to either end of the playmat 10 is termed the Navia square in the present invention. The Navia square is were the game piece referred to as the Navia is placed at the start of each game. On either side, to the right and left, of the Navia square 20 are the summons squares 30. There are three summon squares on the left of the Navia square 20 and three summon squares on the right of the Navia square 20 in the embodiment shown in FIG. 1. Additionally there are summon squares 30 in the second to the closest row of squares to either end of the Battlefield 15 but only on the far side of either row. The significance of these squares will become evident below in the discussion of the various game pieces used to practice the present invention.

The five middle squares of the middle row of the Battlefield 10 are called the reduction zone squares 40. If a player attempts to alter the properties of one of his game pieces during play, he or she must pay a fee in imaginary currency to do so. This fee is predetermined and depicted on the piece itself. However if the player attempts to alter the properties of one of his game pieces and the game piece is situated on one of these reduction zone squares 40, the cost normally charged to the player is reduced in half. If that one half reduction results in a number which is not a whole number, it is rounded up to the next whole number. For example if the normal cost was 7 then the cost in the reduction zone would be 3.5. Because 3.5 is not a whole number it would be rounded up to 4.

The imaginary currency used in the game is referred to as Gyullas. However any term could be used without altering the manner in which the game is played. There is a section termed the Gyullas Vault 50 located to the right of each player as he or she faces his or her side of the playmat. Gyullas are stored in the Gyullas Vault 50 before being earned and after being spent by a player. Directly adjacent to the Gyullas Vault 50 is the Gyullas Pool 60 where the players store the Gyullas they earn while playing the game.

Located on the left side of the playmat on each players side is a section called the Graveyard 70. Game pieces which are defeated or taken by the opposing player are placed in this space.

There are seven spaces at either end of the playmat which are outside the Battlefield 15. In one embodiment of the game these spaces are referred to as the Maseitai Keep 90 and is the place where a special group of game pieces called the Maseitai are keep until they are summoned onto the Battlefield 15 by a player. In between the Maseitai Keep 90 and the Battlefield is a line which is referred to as the End Line 80.

II. Game Pieces

As mentioned above, one aspect of the present invention is that the game pieces used have different capabilities which in some instances can be changed. Each type of game piece and its capabilities will be discussed below using the names used to describe them in Navia Dratp game. However, these terms are only used for purposes of explanation and do not limit the terms that can be used to describe these pieces.

Figure 8:
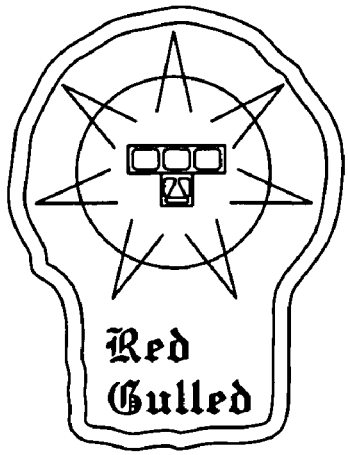
FIG. 8 is a drawing of another game piece used to play the board game disclosed herein.

The first piece is shown as FIG. 8 and is termed a Black Gulled. The Black Gulled can move one space forward per turn. Each time a player moves his or her Black Gulled, the player earns one Gyullas.

Figure 7:
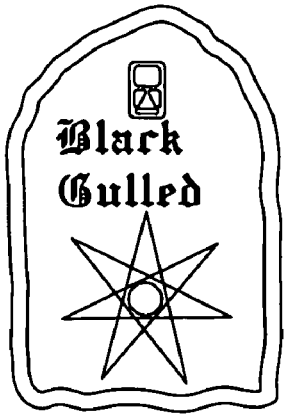
FIG. 7 is a drawing of another game piece used to play the board game disclosed herein.

The next piece is shown in FIG. 7 and is termed a Red Gulled. The Red Gulled can be moved one space forward in one of three directions. That is it can either move one space directly forward or one space forward at a diagonal into the space forward and to the right or left of its starting position. Each time a player moves his or her Red Gulled the player earns 3 Gyullas.

The next game piece is referred to as a Maseitai. FIGS. 2–6 depict a one embodiment of a Maseitai. Looking at FIG. 2 it can be seen that the Maseitai has a FIG. 150 attached to a base 140. Each Maseitai has a unique figure attached to it. Also attached to the base 140 of the Maseitai game piece is a disc or compass 120 which is rotatable. Placed on the top 122 and the bottom 124 sides of the compass 120 is an insert 130 which describes which movement the Maseitai is capable of or which special features or powers the Maseitai possesses. There are two inserts 130 located on either side of the compass 120. The two inserts 130 on each compass 120 of each Maseitai are different. The capabilities of the Maseitai, such as movement, are depicted on the insert 130 and which ever insert is facing up controls the particular Maseitai. Thus the capabilities of the Maseitai can be changed by rotating by 180° the compass 120 to reveal the insert underneath.

Figure 9:
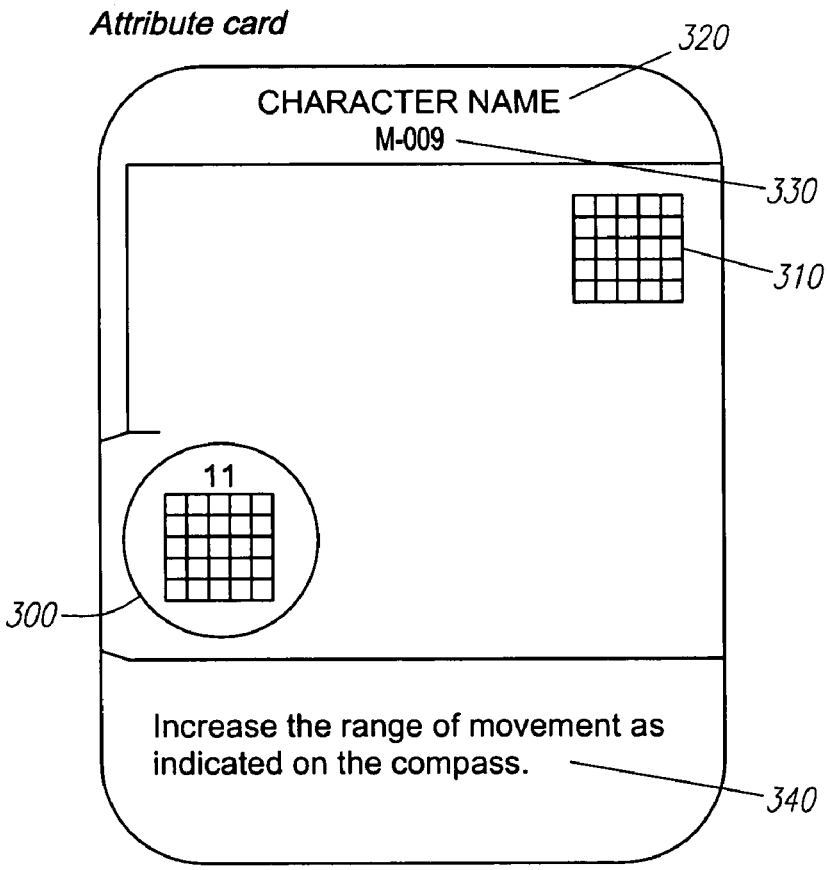
FIG. 9 is a drawing of a card which disclosed various aspects of the game pieces used to play the game disclosed herein.
Figure 10:
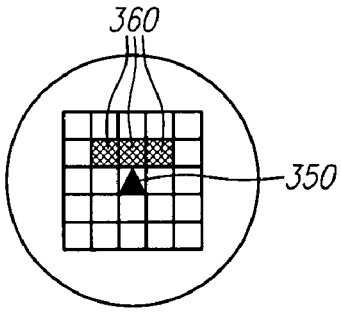
FIGS. 10–16 are various movement grids for a game piece as disclosed herein.

The compasses of all Maseitai have at least one insert which is a movement grid which describes who the Maseitai may move on the playmat. FIG. 10 is a drawing of a typical movement grid which would be the insert to the Maseitai's compass. The movement grid consists of a grid of squares arranged in a five-by-five pattern. Looking to FIG. 10, the triangle 350 in the middle of the movement grid represents the current position of the Maseitai on the playmat. The shaded squares 360 represent the movement that the Maseitai is allowed to make while this particular movement grid is displayed face up on the compass. The insert on the other side of the compass reveals a special power, termed the Dratp effect, unique to a particular Maseitai. When the game starts, the compass will be oriented such that the insert showing the Dratp effect is face down and not viewed by the players. Additionally, on the underside of the base 140 of each Maseitai there is a description of the Dratp effect of that Maseitai. Thus, the player never needs to go to any outside source to determine the Dratp effect of a particular Maseitai. However, there are cards called Attribute Cards (FIG. 9) which provide all the information of a specific Maseitai such as its name, its normal movement grid, and its Dratp effect.

When play begins the act of rotating the compass on the Maseitai to reveal the Dratp effect is referred to a Dratping. Dratping enhances the power of the specific Maseitai and thus its ability to battle the opponents game pieces on the Battlefield. The unique power of the particular Maseitai are referred to as Dratp effect. It costs the player a specific number of Gyullas to Dratp. The Gyullas spent to draft are taken from the player's Gyullas Pool and moved to the player's Gyullas Vault.

Figure 5:
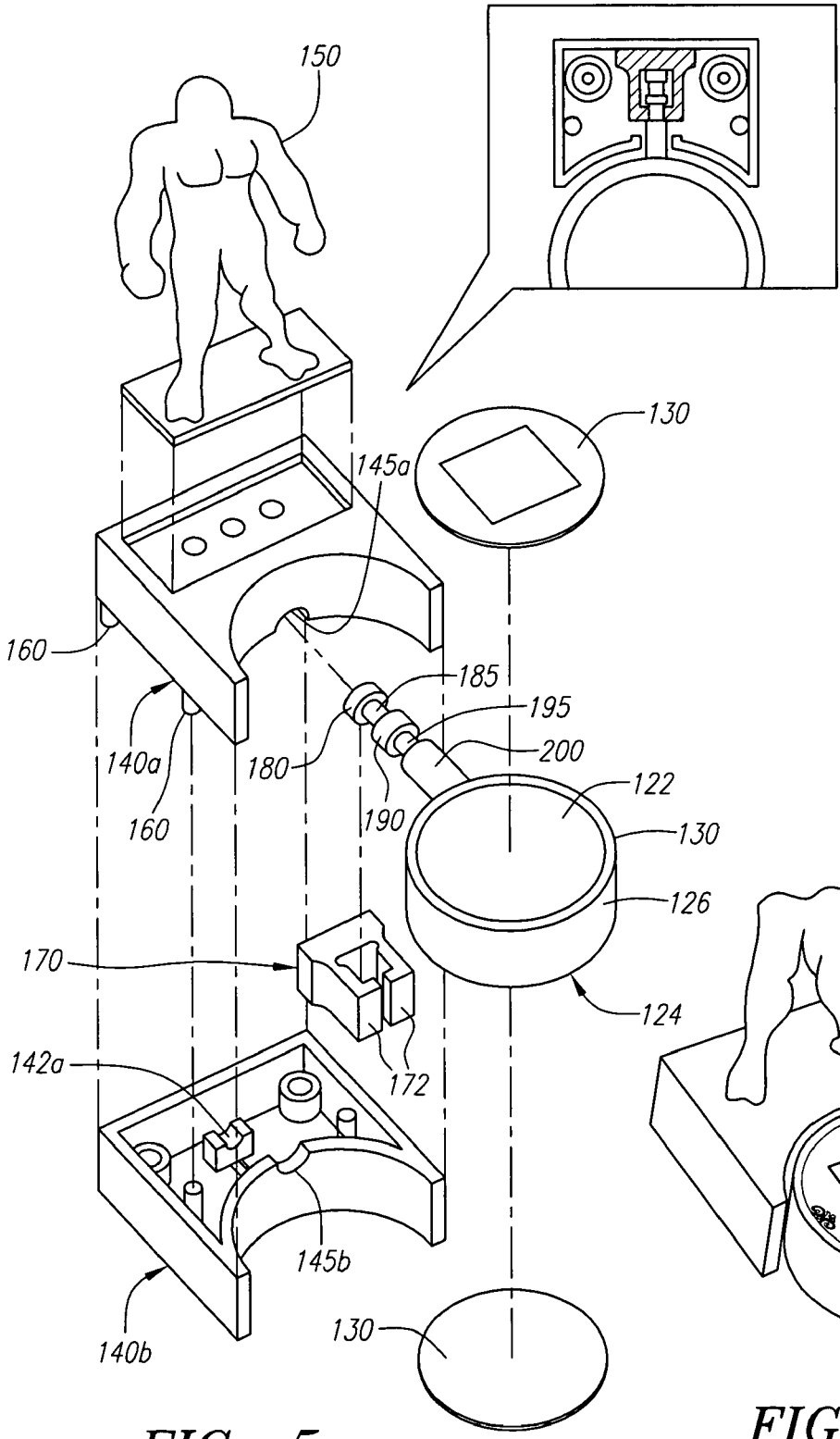
FIG. 5 is an exploded view of the game piece.
Figure 6:
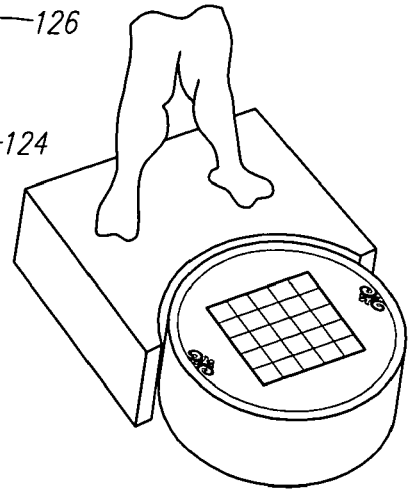
FIG. 6 is another drawing of a perspective view of the game piece.

FIG. 6 is an exploded view of the of a game piece which can be used for both the Maseitai and the Navia. The exploded view details the inner workings of the game piece which allow the compass to rotate about its axis so players can perform a Dratp during the game. The game piece consists of the compass 120 which is generally round in shape. However other shapes could work equally as well for the compass. The compass has a top side 122 a bottom side 124 and a side 126. Attached to and extending from the side 126 of the compass is a shaft 200 which connects the compass to the base 140 of the game piece. In the embodiment depicted in FIG. 6, the shaft 200 is substantially uniform in diameter except for two sections 195 and 185 which are of a smaller diameter then the remaining shaft 200. Section 195 of the shaft further differs from the remaining shaft 200 in that it consists of four flat sides as opposed to a round shaft. Section 195, in conjunction with guide piece 170, operate to limit the free spinning of the compass. As the compass is rotated, a flat side of section 195 will come in contact with a flat side of guide piece 170 and which will allow the compass to be held in a certain position. As pressure is applied to continue rotation the corners of the section 195 will force apart the ends 172 of the guide piece 170 and allow the compass to continue rotation to the next flat section of section 195. In the configuration shown in FIG. 5 section 195 has four sides. This would result in the compass 120 stopping at four distinct positions as it rotates about the axis of the shaft 200. Starting at 0° the compass would rotate and stop at 90°. As pressure is applied to overcome the pressure exerted by the guide piece 170 on section 195 the compass 120 would again begin to rotate this time from 90° through to 180°. Such would continue throughout a 360° rotation of the compass 120. Because section 195 has four sides the compass would stop a 90° intervals. However this could easily be changed by altering the number of sides of section 195.

The shaft 200 and guide piece 170 are both placed inside the base 140 which is equipped to accept the shaft and hold it in place. In FIG. 5 the base 140 is separated into two pieces 140*a* and 140*b*. When 140*a* and 140*b* are joined together the shaft 200 goes through the base 140 through a complementary hole formed by 145*a* and 145*b*.

Section 185 of the shaft 200 fits into the small guide piece formed when 142*a* and 142*b* (not shown) are joined together with the joining together of 140*a* and 140*b*. The combination of the joining together of 142*a* and 142*b* and 145*a* and 145*b* provide guides which allow the compass 120 to turn.

Figure 11:
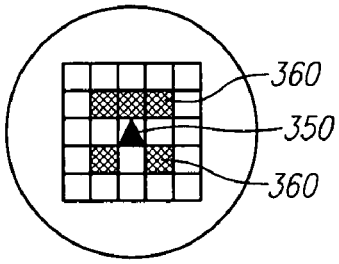
Figure 12:
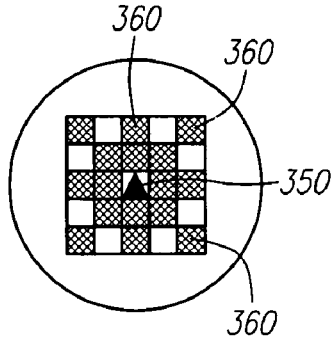

There are several basic groups of Dratp effects. For instance one Dratp effect is enhanced movement. When the Maseitai is Dratped a new movement grid is revealed thereby expanding the range of movement of the Maseitai. FIGS. 11 and 12 demonstrate the differences there can be between the initial movement grid (FIG. 11) and the Dratped enhanced movement grid (FIG. 12) of a Maseitai. FIG. 11 shows a fairly limited range of movement. The triangle represents the Maseitai and it can move to any of the shaded squares. FIG. 12 again shows the Maseitai represented by the triangle but with a greatly increased number of shaded squares depicting where the Maseitai can move.

Figure 13:
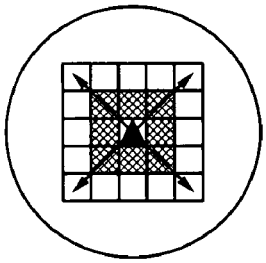

FIG. 13 depicts yet another type of enhanced movement grid. The solid arrows indicate that a Maseitai can move in the direction indicated by the arrows an unlimited amount of spaces provided the path on the playmat is not blocked by another game piece. Thus in FIG. 13 the Maseitai can move an unlimited number of spaces diagonally relative to its position on the playmat.

Figure 14:
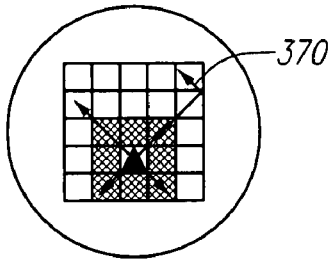
Figure 15:
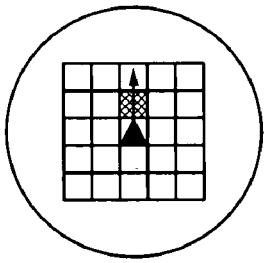

Another type of Dratp effect is termed Bounce. This is a variation of the enhanced movement Dratp effect. The Bounce effect allows the Maseitai to bounce off the edge of the Battlefield and continue moving in a given direction. FIG. 14 depicts a movement grid of a bounce Dratp effect. As can be seen, the Maseitai can move an unlimited amount of spaces diagonally in three different directions as indicated by the solid arrows. Additionally, if the Maseitai moves in the direction of the fourth diagonal arrow with the ninety degree bend in it 370 it can bounce of the edge of the Battlefield and continue along in the new diagonal direction indicated by the arrow.

Another type of Dratp effect is the jump effect. The jump effect is indicated by dashed arrows and allows the Maseitai to move in the indicated direction an unlimited amount of spaces with the added ability of being able to jump one game piece blocking its path. Figure depicts a movement grid which indicates the enhanced jump effect.

Sacrifice is a Dratp effect that allows the player to remove one game piece from the Battlefield (even the players own). However, when a player Dratps the Maseitai with the sacrifice effect must also go to the graveyard. The compass insert of a Maseitai with a sacrifice Dratp effect is marked with a skull instead of a movement grid like the enhanced movement Maseitai.

Another Dratp effect is continuous when the Dratp effect is continuous it remains in effect until the Maseitai with that effect is removed from the Battlefield. For example a player's Maseitai could provide that on Dratping the player could choose one game piece of his or her choice (even the player's own piece) from the Battlefield and ban all moves and Dratp effects for the game piece while the player's piece remains on the Battlefield.

Figure 16:
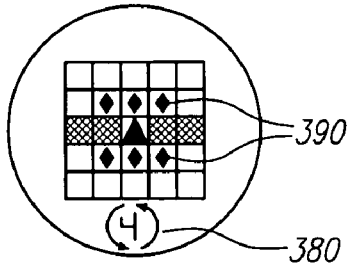

Another class of Dratp effects are the Invoke Dratp effects. Invoke allows the player to activate a certain Dratp effect by paying Gyullas. FIG. 16 depicts the Dratp effect insert for a Maseitai with this effect which is marked with a specific symbol, a number encircled by two arrows 380. The number inside the arrows indicates how much the player has to pay each time he wishes to invoke the Dratp effect. The Dratp effect in FIG. 16 would allow the player to move a game piece from any spot on the Battlefield to one of the spaces indicated by the diamonds 390.

Another Dratp effect is Immortality. Once a Maseitai with the Dratp power of immortality Dratps, it can only be removed from the Battlefield by a Maseitai with a Sacrifice Dratp effect.

There is another type of Maseitai termed the Navia Guard Maseitai. The Navia Guard Maseitai are identical to other Maseitai except that Navia Guard Maseitai cannot be summoned to a summon square. Instead, the Navia Guard Maseitai must be summoned to one of the eight spaces surrounding the space occupied by the player's Navia. The Navia Guard Maseitai can be summoned to any one of the eight surrounding spaces so long as the space is unoccupied.

The last game piece which each player has is the Navia. The Navia game piece is structurally the same as the Maseitai. However, the Navia are a crucial game pieces which must be protected by each player. If an opponent takes the others Navia then he wins the game. The Navia have a compass with a movement grid on one side. Also the Navia can Dratp and in fact if a player performs a Navia Dratp he or she wins the game. However, the Navia is the most expansive game piece to Dratp costing 60 Gyullas.

III. Gyullas

As noted above, Gyullas is the term used for the imaginary currency used to play the game. It is the Gyullas which are need to Dratp both the Maseitai and the Navia. In Navia Dratp the Gyullas are represented by small crystal shaped pieces. However, many different types of objects could be used as imaginary currency as long as such objects provided the players with a method of keeping track of their respective levels of available currency.

Gyullas are earned by moving the Gulled game pieces. Movement of a Black Gulled earns one Gyulla and movement of a Red Gulled earns three Gyullas. However, players do not earn Gyullas for the movement of Maseitai unless the particular Maseitai specifically provides so.

A player who defeats an opponent's Maseitai on the Battlefield earns Gyullas equal to the Dratp effect cost of the Maseitai. A player that defeats an opponents Gulled on the Battlefield earns one Gyullas for a Black Gulled and three Gyullas for a Red Gulled.

Lastly a player can earn Gyullas by performing a Line Over. A Line Over occurs when a player succeeds in moving his or her Red or Black Gulled from one end of the Battlefield to the other and crossing his opponents end line.

IV. Playing the Game

Figure 17:
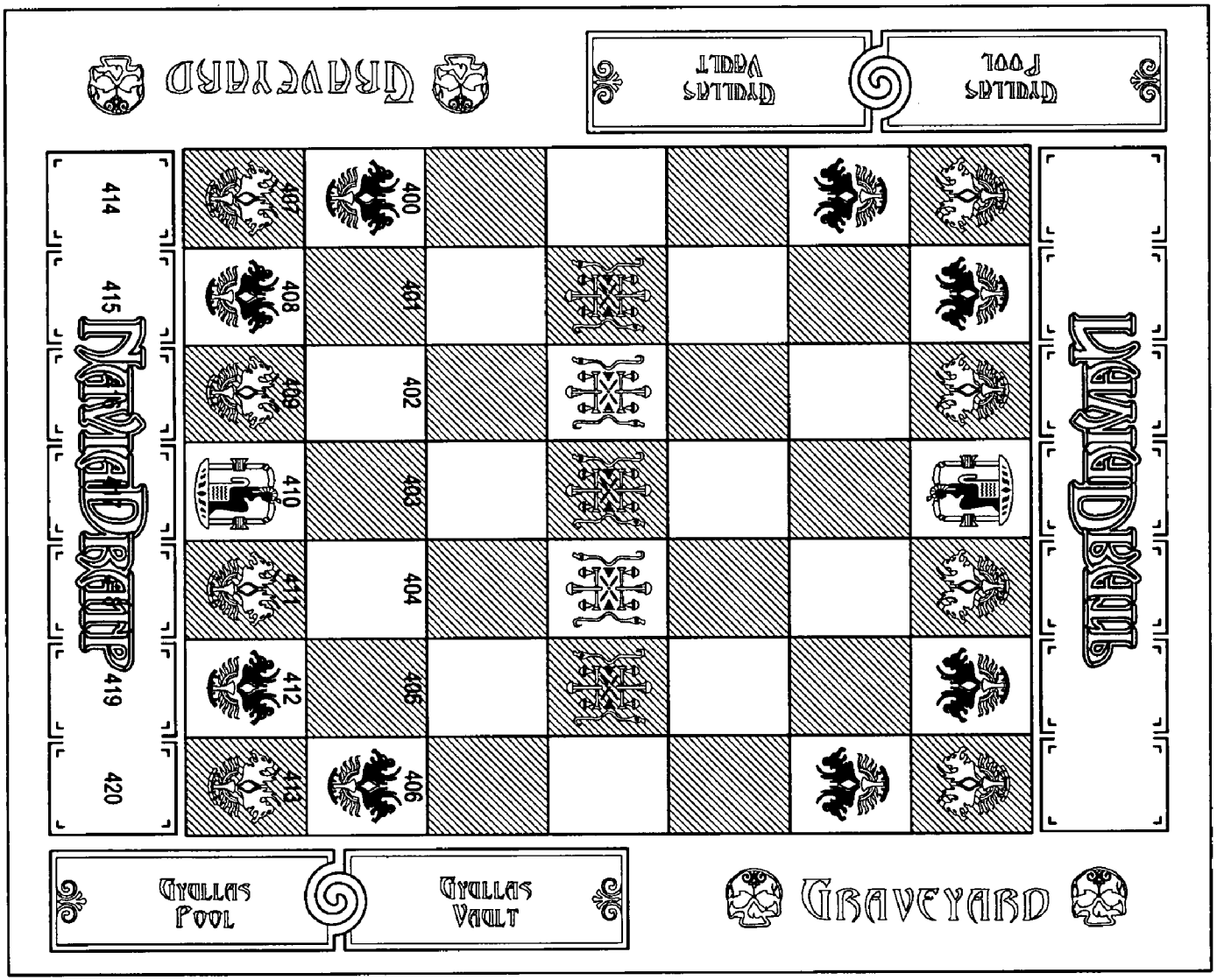
FIG. 17 is another drawing of the game board depicted in FIG. 1 wherein various squares have been provided with reference numerals to show where various game pieces are placed at the beginning of game play.

The first step in playing the game is to arrange the game on the playmat. Each player starts with the following number and type of game pieces: 1 Navia, 7 Black Gulled, 2 Red Gulled, and 7 Maseitai. One side of the playmat in FIG. 17 has been labeled with reference numerals 400 through 420 to help describe where each game piece for one player is placed on the playmat.

A single Black Gulled is placed in spaces 400 through 406. The Navia is placed in space 410. On either side of the Navia a Red Gulled is placed in space 408 and 412. In each space 414 through 420 a single Maseitai is placed. The opponents side on the opposite side of the playmat is set up as a mirror image of that which is described above.

After determining who goes first, the first turn begins with player one either moving a Gulled (Red or Black) or summoning a Maseitai to one of their four open summon squares. Play then continues alternating between both players. On each turn, a player may either move one Gulled or Maseitai or summon a Maseitai. Players may also choose to Dratp during a turn. A player is allowed to move a Maseitai and then perform a Dratp with the same Maseitai on the same turn. However, a move is not permitted after a Dratp unless specifically noted.

Maseitai move according to the movement grid displayed on their compass. A players move of any game piece is considered final-when he or she removes his or her hand.

A player is allowed to summon one Maseitai per turn. No Gyullas are paid to summon a Maseitai to the Battlefield. A player choosing to summon a Maseitai can do nothing else during the same turn.

To Dratp, a player must pay the Dratp cost indicated on the Maseitai's compass using Gyullas. Once the Dratp cost is paid, the Maseitai's compass is rotated until the underside of the compass is facing up. Some Dratp effects occur immediately, as stated in the Dratp effect text. Other Dratp effects, and increased or decreased movement granted by Dratping, take effect during that player's next turn. Dratping is the last action performed during a players turn. A player can move and Dratp but the he or she cannot Dratp then move. Additionally, a player cannot move a Red or Black Gulled and then Dratp a Maseitai on the same turn.

A Navia Dratp is one way to win the game. As with a Dratp performed on a Maseitai, a Navia Dratp can be performed by simply paying the Dratp cost. However, the Navia Dratp cost is 60 Gyullas. Also a Navia does not benefit from the Reduction Zone in the middle of the Battlefield. The cost to Dratp a Navia is always 60 Gyullas. Additionally, a Navia cannot perform a Dratp if it is in Check (see discussion of check below).

When a players Maseitai or Gulled lands on a square occupied by an opponent's Maseitai or Gulled, the player who moved onto the square takes their opponent's game piece. When a Red or Black Gulled piece is taken, it is removed from the Battlefield and placed in its owner's Graveyard. The player who takes the piece earns one Gyullas for a Black Gulled and three Gyullas for a Red Gulled.

When a Maseitai piece is taken, its is also removed from the Battlefield and placed in its owner's Graveyard. The player who takes the Maseitai earns Gyullas equal to the defeated Maseitai's Dratp cost. However, Maseitai removed from the Battlefield via the use of a Dratp effect earn no Gyullas.

If a players Navia is taken the player who takes it wins the game. When a player moves his game piece into a position were he or she has the capability to take his or her opponent's Navia on his or her next move the Navia is said to be in Check and he or she must warn the opponent of this fact.

If the players enter into a situation were both are in a repetitive movement pattern such that the same movement situation repeats itself for three turns for both players and no Maseitai are summoned by either player the game ends in a draw.

A Line Over occurs when a player succeeds in moving one of their Gulled pieces the length of the Battlefield and over an opponent's End Line. When this occurs the player who performed the Line Over moves their Gulled piece to their own Graveyard. Only a Gulled game piece, and the Navia game piece under certain circumstances, can perform a Line Over. A player who successfully performs a Line Over can choose either of the following: 1) to receive 10 Gyullas; or 2) move one of their Maseitai from their Graveyard to one of their open Summon Squares.

A Navia Goal is a Line Over with a Navia, however, this may only be performed by a player with no Maseitai remaining in their own Maseitai Keep. A player who performs a Navia Goal wins the game.

The Navia is a is a unique game piece that is in an exception to several rules that effect other game pieces: 1) Unless specifically mentioned in a Maseitai Dratp effect, the Navia is not affected; 2) The Navia piece does not receive the reduced Gyullas benefit from the Reduction Zone.

Although specific embodiments of the invention have been discussed above in some detail, it is to be understood that these are offered for purposes of illustration only and are not to be construed as limiting. The actual scope of the invention is defined by the claims which are set forth below.

What is claimed is:

1. A method of playing a board game comprising the steps of:

selecting at least two players;

said players being assigned at least three different types of game pieces;

wherein the movement capabilities of the first type of game piece are fixed and the capabilities of the second game piece can be altered by the players and wherein the movement capabilities of the third type of game piece are fixed and if a player's opponent captures the players third type of game piece then the opponent wins the game;

wherein the players can alter the capabilities of their second type of game piece by paying a predetermined amount of money;

each player starting the game with their game pieces in a predetermined position on a playmat consisting of distinct areas of play said distinct areas having game rules unique to said distinct areas;

each player alternating taking turns moving their assigned game pieces on said playmat in accordance with a movement grid assigned to each particular game piece;

each player attempting to take another players game pieces in order to win the game.

2. The method of playing a board game according to claim 1 wherein the playmat has a distinct challenge area where the players challenge one another with their game pieces in an attempt to take each others game pieces.

3. A method for playing a game according to claim 2 wherein the playmat has a distinct area for keeping a players said second type of game pieces until such time as the player decides to move said second type of game pieces to said challenge area.

4. The method of playing a board game according to claim 1 wherein the playmat has a distinct area where players must place their game pieces which have been taken by their opponent.

5. A method for playing a game according to claim 1 wherein the said amount of money is reduced when the player's game piece is located on a distinct cost reduction zone on the playmat.

6. The method for playing a game according to claim 1 wherein the capability of the second type of game piece changed by the player consists of enhanced powers.

7. The method for playing a game according to claim 6 wherein the enhanced powers, comprise one or more of, enhanced movement, enhanced range, the ability to jump over another game piece, vary direction or sacrifice a game piece to take an opponent's game piece.

8. The method for playing a game according to claim 1 wherein the capability of the second type of game piece changed by the player comprises a special power which may be achieved during each successive turn by paying a predetermined amount of money.

9. The method for playing a game according to claim 1 wherein the capability of the second type of game piece changed by the player comprises an enhanced power which remains in effect until said second type of game piece is taken by an opponent.

10. The method for playing a game according to claim 1 wherein the capability of the second type of game piece changed by the player comprises the power to not be taken except by an opponent using a second type of game piece with power to sacrifice the game piece.

11. A method for playing a game according to claim 1 wherein the third type of game piece can be used to win the game by paying a predetermined amount of money.

12. A method for playing a game according to claim 1 wherein each player earns money by moving the first type of game piece or by taking an opponent's second type of game piece.

13. A method for playing a game according to claim 1 wherein the game is won by moving the players' third type of game piece the length of the playmat and crossing from the challenge area into the distinct area where the opponent stores his second type of game piece before said second type of game piece is moved onto the challenge area by the player.

14. A method of playing a board game having a plurality of squares comprising the steps of:

selecting at least two players;

said players being assigned at least five different types of game pieces;

wherein the movement capabilites of the first and second types of game piece are fixed, the movement capabilities of the third and fourth game pieces can be altered by the players by the payment of a predetermined amount of money and wherein the movement capabilities of the fifth type of game piece are fixed and if a player's opponent captures the player's fifth type of game piece, the opponent wins the game;

wherein each player earns a predetermined amount of money for each move made by the first and second game pieces, each player earns a predetermined amount of money for taking an opponent's piece;

each player earns a predetermined amount of money by moving a piece to specified squares;

each player starting the game with their game pieces in a predetermined position on a playmat consisting of distinct areas of play said distinct areas having game rules unique to said distinct areas;

each player alternating taking turns moving their assigned game pieces on said playmat in accordance with a movement grid assigned to each particular game piece;

each player attempting to take another player's game pieces in order to win the game.

* * * * *